United States Patent [19]

Sugasawa et al.

[11] 4,335,687

[45] Jun. 22, 1982

[54] INTERNAL COMBUSTION ENGINE

[75] Inventors: Fukashi Sugasawa, Yokohama; Haruhiko Iizuka, Yokosuka; Yukihiro Etoh, Yokohama; Toshiaki Tanaka, Fujisawa, all of Japan

[73] Assignee: Nissan Motor Company, Limited, Yokohama, Japan

[21] Appl. No.: 160,616

[22] Filed: Jun. 18, 1980

[30] Foreign Application Priority Data

Jun. 20, 1979 [JP] Japan ..... 54-76889

[51] Int. Cl.[3] ..... F02B 77/00

[52] U.S. Cl. ..... 123/198 F; 123/179 BG; 123/179 L

[58] Field of Search ..... 123/198 F, 481, 179 BG, 123/179 L

[56] References Cited

U.S. PATENT DOCUMENTS

| | | | |
|---|---|---|---|
| 4,007,590 | 2/1977 | Nagai | 123/198 F |
| 4,116,169 | 9/1978 | Krupp et al. | 163/198 F |
| 4,245,471 | 1/1981 | Sugasawa et al. | 123/198 F |
| 4,257,371 | 3/1981 | Ishida | 123/198 F |
| 4,274,382 | 6/1981 | Sugasawa et al. | 123/198 F |

FOREIGN PATENT DOCUMENTS

| | | | |
|---|---|---|---|
| 2844532 | 4/1979 | Fed. Rep. of Germany | 123/198 F |
| 2802200 | 7/1979 | Fed. Rep. of Germany | 123/198 F |
| 2006336 | 5/1979 | United Kingdom | 123/198 F |

*Primary Examiner*—Ronald B. Cox

*Attorney, Agent, or Firm*—Schwartz, Jeffery, Schwaab, Mack, Blumenthal & Koch

[57] ABSTRACT

An internal combustion engine is disclosed which comprises first and second cylinder units each including at least one cylinder, pulse generator means for generating, in synchronism with engine rotation, a fuel injection pulse signal of pulse width proportional to the rate of air flow to said engine, and first and second fuel supply means responsive to the fuel injection pulse signal for supplying, into the first and second cylinder units, respectively, a controlled amount of fuel corresponding to the duty ratio of the fuel injection pulse signal. Control means is provided for cutting off the fuel injection pulse signal to the second fuel supply means when the engine load is below a reference level increasing with an increase in engine temperature except when the engine speed is below a given level at open throttle conditions.

4 Claims, 8 Drawing Figures

INTERNAL COMBUSTION ENGINE

BACKGROUND OF THE INVENTION

1. Field of the invention

This invention relates to improvements in an internal combustion engine of the split type operable on less than all of its cylinders when the engine is below a given value.

2. Description of the Prior Art

In general, internal combustion engines demonstrate higher efficiency and thus higher fuel economy when running under higher load conditions. In view of this fact, split type internal combustion engines have already been proposed which include split engine control means adapted to place the engine operation in a full engine mode where the engine operates on all of the cylinders at high load conditions and place some of cylinders out of operation to shift the engine operation into a split engine mode when the engine load is below a given level. This relatively increases active cylinder loads at low load conditions, resulting in higher fuel economy.

With split engine control means designed to place the engine operation in a split engine mode at idle conditions, however, a cold engine is started with operating only on the active cylinders, resulting in much time required for warming up the inactive cylinders. Thus, it occurs frequently to operate the inactive cylinders before they are not fully warmed up.

In order to eliminate this difficulty, an attempt has been made to force the engine operation to shift into a full engine mode for a predetermined time upon starting an engine even at idle conditions. However, this results in a fuel economy penalty. For example, if an engine is started again just after it is off, the engine operates in a full engine mode in spite of the fact that it is fully warmed up.

It is most preferable to force the engine operation to shift into a full engine mode even at idle conditions before the engine is fully warmed up for prompt engine warming and to shift the engine operation into a split engine mode at idle conditions after the engine is warmed up for minimized useless fuel consumption.

SUMMARY OF THE INVENTION

It is therefore one object of the present invention to provide an improved split type internal combustion engine which can provide superior engine starting characteristics.

Another object of the present invention is to provide an improved split type internal combustion engine wherein prompt engine warming and higher fuel economy can be achieved.

These and other objects are accomplished by forcing the engine operation to shift into a full engine mode before the engine is warmed up and to shift into a split engine mode even at idle conditions as long as the engine is warmed up. Control means is provided for placing the engine operation in a split engine mode when the engine load is below a reference level increasing with an increase in engine temperature except when the engine speed is below a given level at open throttle conditions.

BRIEF DESCRIPTION OF THE DRAWINGS

The present invention will be described in greater detail by reference to the following description taken in connection with the accompanying drawing description taken in connection with the accompanying drawings, in which.

DESCRIPTION OF THE PREFERRED EMBODIMENTS

The present invention will be described in connection with a split type internal combustion engine having three active cylinders being always active and three inactive cylinders being inactive when the engine load is below a given value. It is to be noted, however, that the particular engine shown is only for illustrative purposes and the structure of this invention could be readily applied to any split engine structure.

Figure 1:
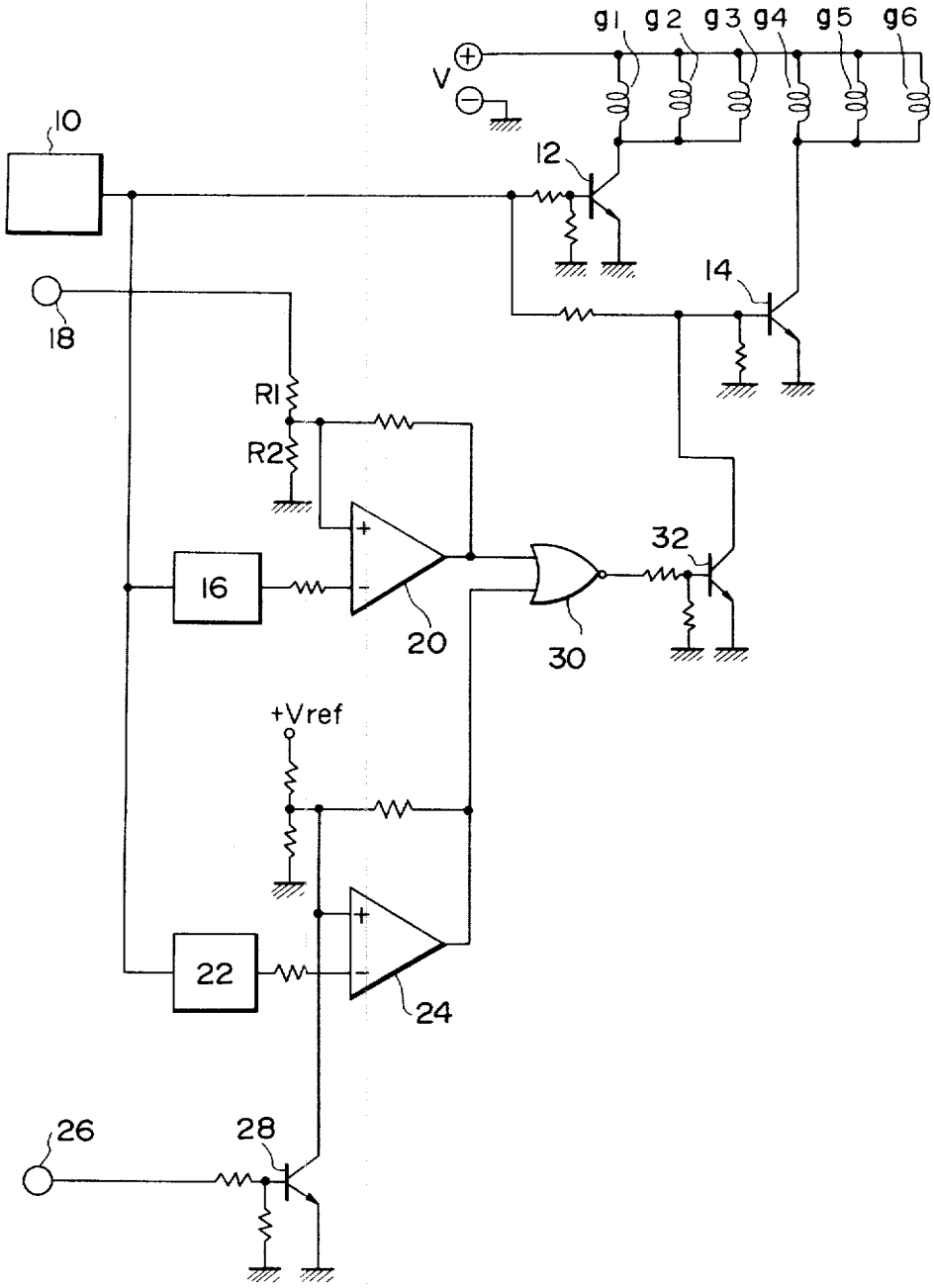
FIG. 1 is a circuit diagram showing one embodiment of the present invention.

Referring now to FIG. 1, the characters $g_1$ to $g_3$ designate a first group of fuel injection valves for supplying fuel into the respective active cylinders and the characters $g_4$ to $g_6$ a second group of fuel injection valves for supplying fuel into the respective inactive cylinders. An injection control circuit 10 is provided which generates, in synchronism with engine rotation, a fuel injection pulse signal of pulse width proportional to the rate of air flow to the engine and thus representive of the load at which the engine is operating. The fuel injection pulse signal is applied to a first switch circuit 12 which thereby becomes conductive to operate the first group of fuel injection valves $g_1$ to $g_3$ and also to a second switch circuit 14 which thereby becomes conductive to operate the second group of fuel injection valves $g_4$ to $g_6$. The average opening degree of each fuel injection valve and thus the fuel flow rate into the corresponding cylinder is determined by the duty ratio of the fuel injection pulse signal.

Figure 3:
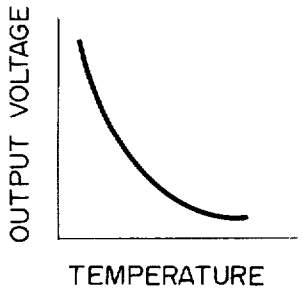
FIG. 3 is a graph showing the output characteristics of the engine warming condition sensor of FIG. 1.
Figure 2:
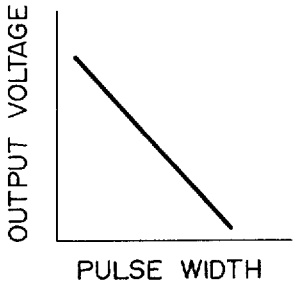
FIG. 2 is a graph showing the output characteristics of the first converter of FIG. 1.
Figure 4:
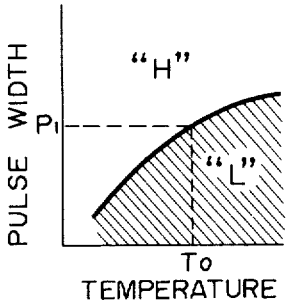
FIG. 4 is a graph used to explain the operation of the first comparator of FIG. 1.

The fuel injection pulse signal is also fed to a first converter 16 in which it is converted into a voltage signal indicative of engine load. The first converter 16 may be adapted to provide a voltage which decreases as the pulse width of the fuel injection pulse signal increases, as shown in FIG. 2. The reference numeral 18 designates an engine warming condition sensor which may be in the form of a temperature sensor adapted to provide a voltage signal inversely proportional to engine coolant temperature, as shown in FIG. 3. The output voltage of the engine warming condition sensor 18 is divided by resistors $R_1$ and $R_2$ and the divided voltage is applied to one input of a first comparator 20, the other input of which is connected to the output of the first converter 16. The first comparator 18 compares engine load conditions with engine warming conditions to provide a low output "L" when the voltage signal from the first converter 16 is higher than the voltage signal from the sensor 18 and otherwise a high output "H", as shown in FIG. 4. The resistors $R_1$ and $R_2$ are suitably selected to provide a boundary such, for example, as shown in FIG. 4 between low and high first comparator output ranges "L" and "H".

Figure 5:
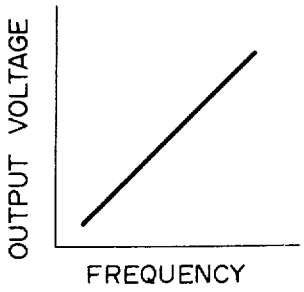
FIG. 5 is a graph showing the output characteristics of the second converter of FIG. 1.
Figure 6:
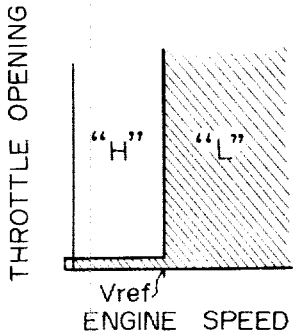
FIG. 6 is a diagram used in explaining the operation of the second comparator of FIG. 1.

In addition, the fuel injection pulse signal is applied to a second converter 22 in which it is converted into a voltage signal indicative of engine speed. The second converter 22 may be adapted to provide a voltage signal proportional to the frequency of the fuel injection pulse signal, as shown in FIG. 5. The output of the second converter 22 is connected to one input of a second comparator 24, the other input of which is connected to a reference voltage source $+V_{ref}$. The second comparator 24 compares the engine speed indicative voltage with the reference voltage to provide a low output "L" when the engine speed is lower than the reference level and a high output "H" when the engine speed is higher than the reference level, as shown in FIG. 6. A throttle opening sensor 26 is provided which is adapted to provide an idling condition indicative signal when the throttle valve is at closed positions. The idle condition indicative signal is applied to a third switch circuit 28 which thereby becomes conductive to reduce the reference voltage to zero so that the second comparator 24 can provide a low output "L" regardless of engine speed.

The reference numeral 30 designates a NOR circuit which has inputs from the first and second comparators 20 and 24 to provide a high output "H" only when both of the inputs thereof are low. The high output of the NOR circuit 30 is applied to a fourth switch circuit 32 which thereby cuts off the fuel injection pulse signal to the second switch circuit 14. As a result, the second group of fuel injection valves $g_4$ to $g_6$ become in operative to cut off the flow of fuel to the in active cylinders and the engine operation is placed in a split engine mode.

Figure 7:
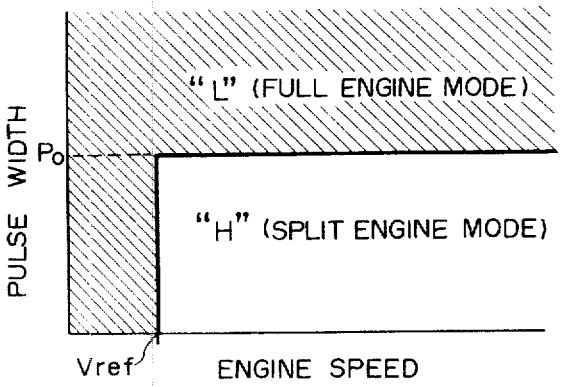
FIGS. 7 and 8 are diagrams used to explain the operation of the NOR circuit of FIG. 1.
Figure 8:
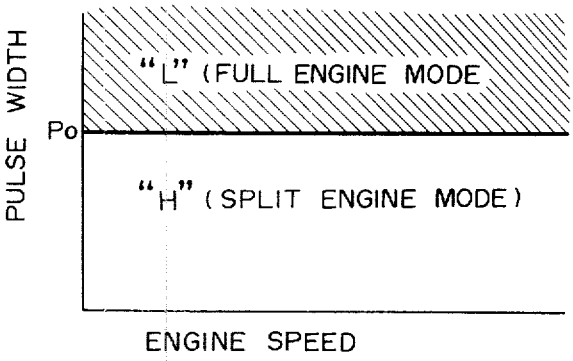

FIG. 7 shows the ranges where the NOR circuit 30 provides low and high outputs "L" and "H" at open throttle conditions and FIG. 8 shows the ranges where it provides low and high outputs "L" and "H" at closed throttle conditions. In FIGS. 7 and 8, the pulse width Po corresponds to the pulse width laying on the border between the ranges "L" and "H" in FIG. 4 and represents a condition at which the engine operation is shifted between split and full engine modes.

The operation of the present invention is as follows:

Assuming first that the engine is started in cold conditions and the throttle valve is fully closed just after the engine is started as normally done, the engine immediately operates in idle conditions and rotates at idle speeds. As soon as the throttle valve is fully closed, the throttle opening sensor 26 provides an idle condition indicative signal to reduce the reference level to zero, whereby the second comparator 24 provides a low output "L". Before the engine coolant temperature increases above a level To (FIG. 4) which represents an engine coolant temperature to be considered as the engine being warmed up at an idle condition where the pulse width of the fuel injection pulse signal is at a value $P_1$, the first comparator 20 provides a high output "H". Accordingly, the NOR circuit 30 has high and low inputs and provides a low output "L", thereby placing the engine in a full engine mode of operation. This operation mode continues until the engine is fully warmed up.

When the engine is fully warmed up, the output of the first comparator 20 changes to its low level "L". If the throttle valve is held fully closed or the engine speed is below the reference level, the second comparator 24 continues to provide a low output "L". Accordingly, the output of the NOR circuit 30 changes to its high level "H" so as to cut off the fuel injection pulse signal to the second group of fuel injection valves $g_4$ to $g_6$, thereby shifting the engine operation into a split engine mode.

In warm conditions where the engine coolant temperature is held substantially constant, the mode of operation of the engine is dependent upon engine load represented by the pulse width of the fuel injection pulse signal and engine speed represented by the frequency thereof. That is, assuming that the throttle valve is closed, the engine operation is in its split engine mode when the engine speed is above the reference level and the engine load is below a predetermined level represented by the pulse width Po and determined by engine coolant temperature, and is in its full engine mode under the other conditions, as shown in FIG. 7. At open throttle conditions, the engine operation is in its split engine mode regardless of engine speed as long as the engine load is below the predetermined level represented by the pulse width Po, and is in its full engine mode if the engine load is above the predetermined value, as shown in FIG. 8.

According to the present invention, the engine operation is held in its full engine mode before the engine is warmed up, with resulting prompt engine warming. In addition, the engine operation is shifted into a split engine mode even at idle conditions as long as the engine is warmed up. This is effective to minimize useless fuel consumption.

While the present invention has been described in conjunction with a specific embodiment thereof, it is evident that many alternatives, modifications and variations will be apparent to those skilled in the art. Accordingly, it is intended to embrace all alternatives, modifications and variations that fall within the spirit and broad scope of the appended claims.

What is claimed is:

1. An internal combustion engine comprising:

(a) first and second cylinder units each including at least one cylinder;

(b) pulse generator means for generating, in synchronism with engine rotation, a fuel injection pulse signal of pulse width proportional to the rate of air flow to said engine;

(c) first and second fuel supply means responsive to the fuel injection pulse signal for supplying, into said first and second cylinder units, respectively, a controlled amount of fuel corresponding to the duty ratio of the fuel injection pulse signal; and (d) control means for cutting off the fuel injection pulse signal to said second fuel supply means when the engine load is below a reference level increasing with an increase in engine temperature except when the engine speed is below a given level at open throttle conditions.

2. An internal combustion engine according to claim 1, wherein said control means comprises an engine temperature sensor adapted to provide a signal corresponding to engine temperature, a load detector adapted to provide a signal corresponding to engine load, a first circuit having its output placed in one state when the signal from said load detector is higher than the signal from said sensor, a speed detector adapted to provide a signal proportional to engine speed, a second circuit having its output placed in one state when the signal from said speed detector is higher than a reference level, means responsive to closed throttle conditions for placing the output of said second circuit in its one state, and means for cutting off the fuel injection pulse signal to said second fuel supply means when both of the outputs of said first and second circuits are in the one state.

3. An internal combustion engine according to claim 2, wherein said sensor is in the form of a temperature sensor adapted to provide a signal inversely proportional to engine coolant temperature, and said load detector is in the form of a converter for converting the fuel injection pulse signal into a signal decreasing as the pulse width of the fuel injection pulse signal increases.

4. An internal combustion engine according to claim 2, wherein said speed detector is in the form of a converter for converting the fuel injection pulse signal into a voltage signal proportional to the frequency of the fuel injection pulse signal.

* * * * *